US010707619B2

(12) United States Patent
Suzuki et al.

(10) Patent No.: US 10,707,619 B2
(45) Date of Patent: Jul. 7, 2020

(54) MOVABLE CONNECTOR

(71) Applicant: IRISO ELECTRONICS CO., LTD., Yokohama-shi, Kanagawa (JP)

(72) Inventors: Hitoshi Suzuki, Yokohama (JP); Takashi Doi, Yokohama (JP); Yoshiyuki Ogura, Yokohama (JP); Hiroaki Kobayashi, Yokohama (JP)

(73) Assignee: IRISO ELECTRONICS CO., LTD., Yokohama-Shi (JP)

( * ) Notice: Subject to any disclaimer, the term of this patent is extended or adjusted under 35 U.S.C. 154(b) by 0 days.

(21) Appl. No.: 16/193,023

(22) Filed: Nov. 16, 2018

(65) Prior Publication Data

US 2019/0157806 A1 May 23, 2019

(30) Foreign Application Priority Data

Nov. 17, 2017 (JP) ..... 2017-221625

(51) Int. Cl.
*H01R 13/631* (2006.01)
*H01R 12/71* (2011.01)
(Continued)

(52) U.S. Cl.
CPC ..... *H01R 13/6315* (2013.01); *H01R 12/716* (2013.01); *H01R 13/26* (2013.01);
(Continued)

(58) Field of Classification Search
CPC .. H01R 13/6315; H01R 12/716; H01R 13/26; H01R 13/415; H01R 13/502; H01R 12/91
(Continued)

(56) References Cited

U.S. PATENT DOCUMENTS 5,306,168 A * 4/1994 Kunishi ..... H01R 13/6315 439/248
5,725,385 A * 3/1998 Takano ..... H05K 5/0265 439/541.5
(Continued)

FOREIGN PATENT DOCUMENTS

EP 1 986 285 A1 10/2008
EP 2 806 502 A1 11/2014
(Continued)

OTHER PUBLICATIONS

The extended European Search Report dated Mar. 21, 2019, by the European Patent Office in corresponding European Patent Application No. 18205585.5-1201. (9 pages).

*Primary Examiner* — Travis S Chambers
(74) *Attorney, Agent, or Firm* — Buchanan Ingersoll & Rooney PC

(57) ABSTRACT

A movable connector includes a movable housing and a plurality of terminals. Each terminal includes a movable portion and a contact portion. The terminal includes a second fixed portion fixed to the movable housing. The second fixed portion includes a first fixed piece portion connected to the contact portion. The first fixed piece portion has press-fit shoulders, to which a pressing force is applied by using a press-fit jig during press-fitting into the movable housing. The second fixed portion further includes a second fixed piece portion connected to the movable portion and a connecting section connecting the first fixed piece portion to the second fixed piece portion.

7 Claims, 6 Drawing Sheets

(51) Int. Cl.

| | |
|---|---|
| ***H01R 13/26*** | (2006.01) |
| ***H01R 13/41*** | (2006.01) |
| ***H01R 13/415*** | (2006.01) |
| ***H01R 13/502*** | (2006.01) |
| *H01R 12/91* | (2011.01) |

(52) U.S. Cl.
CPC ..... *H01R 13/41* (2013.01); *H01R 13/415* (2013.01); *H01R 13/502* (2013.01); *H01R 12/91* (2013.01)

(58) Field of Classification Search
USPC ..... 439/248, 247, 246, 752
See application file for complete search history.

(56) References Cited

U.S. PATENT DOCUMENTS

| | | | | |
|---|---|---|---|---|
| 9,484,656 | B2 | 11/2016 | Doi et al. | |
| 2010/0159749 | A1* | 6/2010 | Ohkuma | H01R 12/712 439/660 |
| 2014/0342614 | A1* | 11/2014 | Yukutake | H01R 13/46 439/626 |
| 2017/0170588 | A1* | 6/2017 | Doi | H01R 12/7005 |
| 2017/0222346 | A1* | 8/2017 | Kobayashi | H01R 12/91 |

FOREIGN PATENT DOCUMENTS

| | | | |
|---|---|---|---|
| JP | 2005209501 | A | 8/2005 |
| JP | 2018-018606 | A | 2/2018 |

* cited by examiner

MOVABLE CONNECTOR

BACKGROUND OF THE INVENTION

1. Field of the Invention

The present invention relates to an electrical connector having a floating function, or a movable connector.

2. Description of the Related Art

Movable connectors are known as connectors to establish highly reliable electrical connection with a connection target. A movable connector includes a fixed housing mounted on, for example, a printed circuit board (hereinafter, referred to as a "board"), and a movable housing including an engagement compartment into which a connection target is inserted, and a plurality of terminals each including a movable portion that has a first end fixed to the fixed housing and a second end fixed to the movable housing and that movably supports the movable housing between the first and second ends (as an example, Japanese Unexamined Patent Application Publication No. 2005-209501). Each terminal includes a fixed-housing fixed piece portion fixed to the fixed housing, a movable-housing fixed piece portion fixed to the movable housing, and a contact portion extending from the movable-housing fixed piece portion into the engagement compartment. The movable portion connects the fixed-housing fixed piece portion to the movable-housing fixed piece portion.

In fabricating such a movable connector, the movable-housing fixed piece portion is press-fitted into and fixed to a terminal attachment groove of the movable housing by using a press-fit jig. The movable-housing fixed piece portion has a press-fit shoulder, on which the press-fit jig is placed to press the movable-housing fixed piece portion, located along an edge of part connected to the movable portion. To form the press-fit shoulder along the edge of this part, for example, the following methods can be used.

A first method involves increasing the plate width of the movable-housing fixed piece portion without reducing the plate width of the movable portion to form a press-fit shoulder along the edge of the movable-housing fixed piece portion. However, an increase in plate width of the movable-housing fixed piece portion inevitably leads to an increase in distance between the adjacent terminals arranged. This makes it difficult to reduce the size of the movable connector by arranging the terminals at a small pitch. A second method involves reducing the plate width of the movable portion without changing the plate width of the movable-housing fixed piece portion to achieve small-pitch arrangement. However, a reduction in plate width of the movable portion leads to a reduction in durability of the movable portion. The movable portion may break due to stress caused by repeated movement of the movable housing. For related-art movable connectors including terminals having such the above-described structure in which the movable portion extends from the movable-housing fixed piece portion having a press-fit shoulder, the first and second methods have insurmountable limitations on small-pitch arrangement of the terminals or the durability of the movable portion. Since the movable portion may break in the second method, it is necessary to use the first method in which the movable portion is unlikely to break. However, there is no effective measure against the above-described disadvantage.

SUMMARY OF THE INVENTION

The present invention has been made in view of the above-described problems in the art. It is an object of the present invention to provide a movable connector that eliminates an increase in plate width of a terminal caused by connection of a movable-housing fixed piece portion having a press-fit shoulder to a movable portion required to have durability.

To accomplish the above-described object, the present invention provides a movable connector configured as follows.

The movable connector according to the present invention includes a first housing, a second housing movable relative to the first housing, and a plurality of terminals each including a first fixed portion fixed to the first housing, a second fixed portion fixed to the second housing, a movable portion connecting the first fixed portion to the second fixed portion and movably supporting the second housing relative to the first housing, and a contact portion extending from the second fixed portion and being configured to be in electrical contact with a connection target. The second fixed portion includes a first fixed piece portion connected to the contact portion. The first fixed piece portion has a press-fit shoulder, to which a pressing force is applied by using a press-fit jig during press-fitting into the second housing. The second fixed portion further includes a second fixed piece portion connected to the movable portion and a connecting section connecting the first fixed piece portion to the second fixed piece portion.

The terminals of the movable connector according to the present invention have a structure in which the connecting section and the second fixed piece portion are interposed between the first fixed piece portion having the press-fit shoulder and the movable portion. This structure differs from that of terminals of a related-art movable connector, or a "single fixed piece portion type" structure in which a contact portion is connected to one end of a single fixed piece portion having a press-fit shoulder and a movable portion is connected to an edge of part including the press-fit shoulder of the fixed piece portion. In the movable connector according to the present invention, therefore, the first fixed piece portion having the press-fit shoulder, the contact portion connected to the first fixed piece portion, the second fixed piece portion, and the movable portion connected to the second fixed piece portion can be independently shaped to achieve their respective functions. In other words, since the first fixed piece portion having the press-fit shoulder, the connecting section, and the second fixed piece portion are interposed between the contact portion and the movable portion in the movable connector according to the present invention, it is unnecessary to arrange the press-fit shoulder and the movable portion along one edge of the first fixed piece portion. The press-fit shoulder and the movable portion are not design constraints on each other, and thus can be freely designed.

Specifically, it is only required that the press-fit shoulder and the connecting section are arranged along an edge of the first fixed piece portion having the press-fit shoulder. The connecting section can have a plate width smaller than that of the movable portion because, unlike the movable portion, the connecting section does not experience stress caused by movably supporting the second housing. Therefore, the overall plate width of the first fixed piece portion can be reduced based on the width of the press-fit shoulder and a plate width necessary for the connecting section, so that the plate width of the contact portion connected to the first fixed piece portion can also be reduced. This contributes to small-pitch arrangement of the terminals.

In addition, since the first fixed piece portion has the press-fit shoulder, the second fixed piece portion does not necessarily have to have a press-fit shoulder. This enables the movable portion connected to an end of the second fixed piece portion to have a plate width and thickness that ensure durability (necessary for a floating function) with which the movable portion can movably support the second housing without breaking due to repeated elastic deformation. Additionally, since the second fixed piece portion does not have to have a press-fit shoulder, the overall plate width of the second fixed piece portion can be reduced. This reduction also contributes to small-pitch arrangement of the terminals.

The first fixed piece portion is connected to the second fixed piece portion by the connecting section. A function required for the connecting section is to connect the first fixed piece portion to the second fixed piece portion. Unlike the movable portion, the connecting section is not required to be resistant to elastic deformation. Therefore, the connecting section can be formed to have the smallest plate width manufacturable, for example. The plate width of the connecting section can be reduced to the extent that the connecting section does not undergo plastic deformation when the terminal is assembled into the second housing.

In the present invention, the connecting section may have a plate width smaller than that of the first fixed piece portion and that of the second fixed piece portion.

According to the present invention, the plate width of the connecting section is smaller than those of the first and second fixed piece portions. Such a configuration enables the first and second fixed piece portions to have a smaller plate width. This leads to a reduction in distance between the adjacent terminals arranged, thus achieving small-pitch arrangement.

In the present invention, the connecting section may extend in an intersecting direction intersecting a press-fit direction in which the first fixed piece portion is press-fitted into the second housing.

According to the present invention, since the connecting section extends in the intersecting direction intersecting the first fixed piece portion. The connecting section does not interfere with placement of the press-fit jig on the press-fit shoulder of the first fixed piece portion, thus allowing smooth press-fitting.

In the present invention, since the second fixed piece portion includes a locking protrusion, on which the pressing force acts through the connecting section during press-fitting of the first fixed piece portion, the locking protrusion is press-fitted in the second housing and prevented from being pulled out of the second housing.

According to the present invention, the pressing force acts on the locking protrusion through the connecting section during press-fitting of the first fixed piece portion, so that the locking protrusion is press-fitted into the second housing and is prevented from being pulled out of the second housing. In other words, as the press-fit shoulder of the first fixed piece portion is press-fitted into the second housing, the locking protrusion of the second fixed piece portion can be press-fitted into the second housing.

In the present invention, the connecting section includes press receiving part, against which the press-fit jig is pressed during press-fitting of the first fixed piece portion into the second housing, exposed by protruding from a surface of the second housing.

According to the present invention, when the first fixed piece portion is press-fitted into the second housing, the press-fit jig is pressed against the press receiving part of the connecting section, so that the second fixed piece portion can be press-fitted into and fixed to the second housing. If the second fixed piece portion fails to be smoothly fitted into the second housing, the connecting section may undergo plastic deformation. Such an undesirable situation can be prevented by pressing the press-fit jig against the press receiving part. Furthermore, pressing the press-fit jig against the press receiving part ensures proper press-fitting of the second fixed piece portion into the second housing.

In the movable connector according to the present invention, small-pitch arrangement of the terminals is achieved while the movable portion is allowed to have durability necessary for the floating function.

DESCRIPTION OF THE PREFERRED EMBODIMENTS

A movable connector according to an embodiment of the present invention will be described below with reference to the drawings. In the present embodiment, a movable connector 1 is mounted on a board P. The movable connector 1 establishes electrical connection between terminals of the mating connector and a circuit on the board P by fitting and connecting a mating connector (not illustrated) serving as a connection target in such a way that the mating connecter is inserted vertically relative to the board P.

Figure 1:
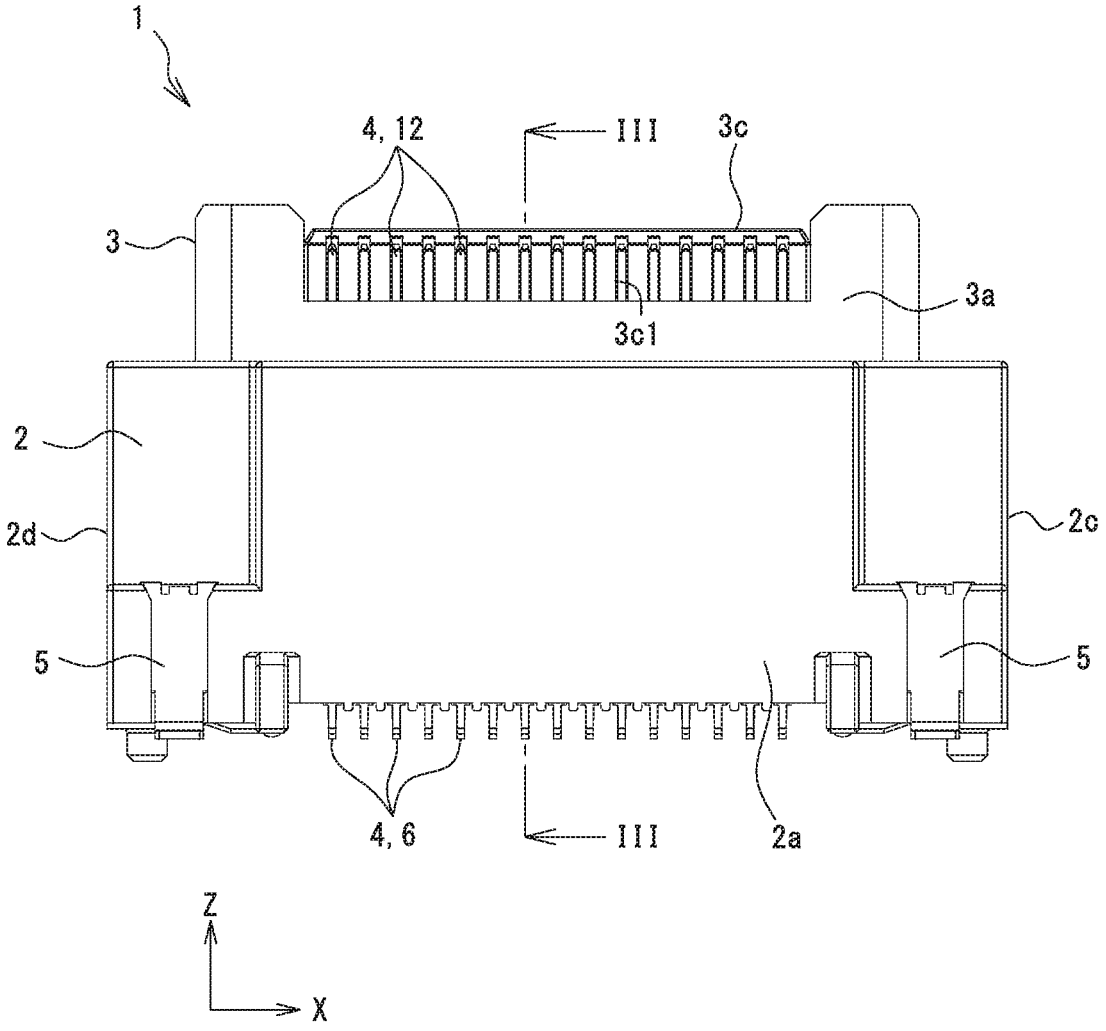
FIG. 1 is a front view of a movable connector according to an embodiment.
Figure 2:
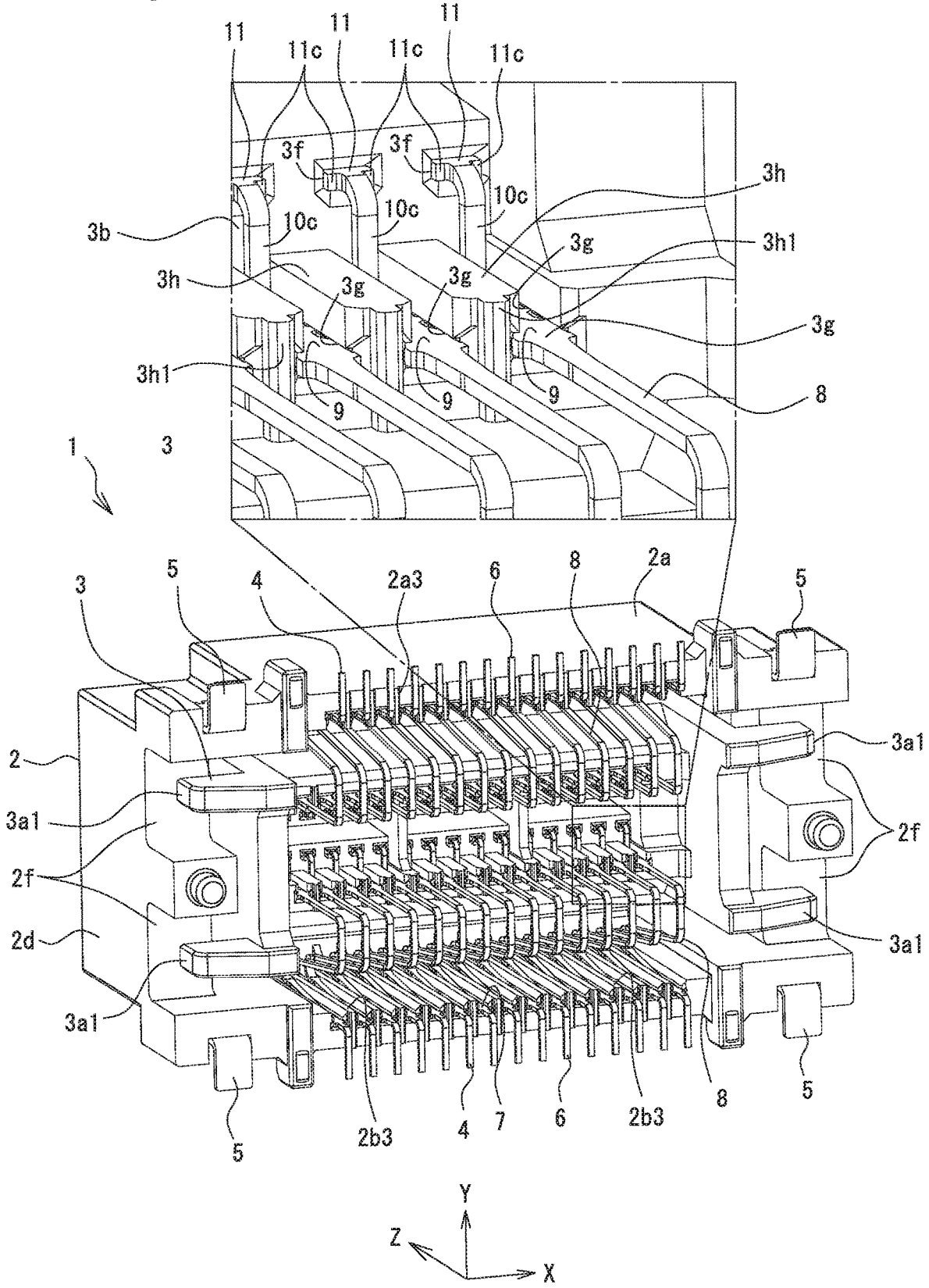
FIG. 2 is a perspective view illustrating the front, bottom, and left side of the movable connector of FIG. 1.
Figure 3:
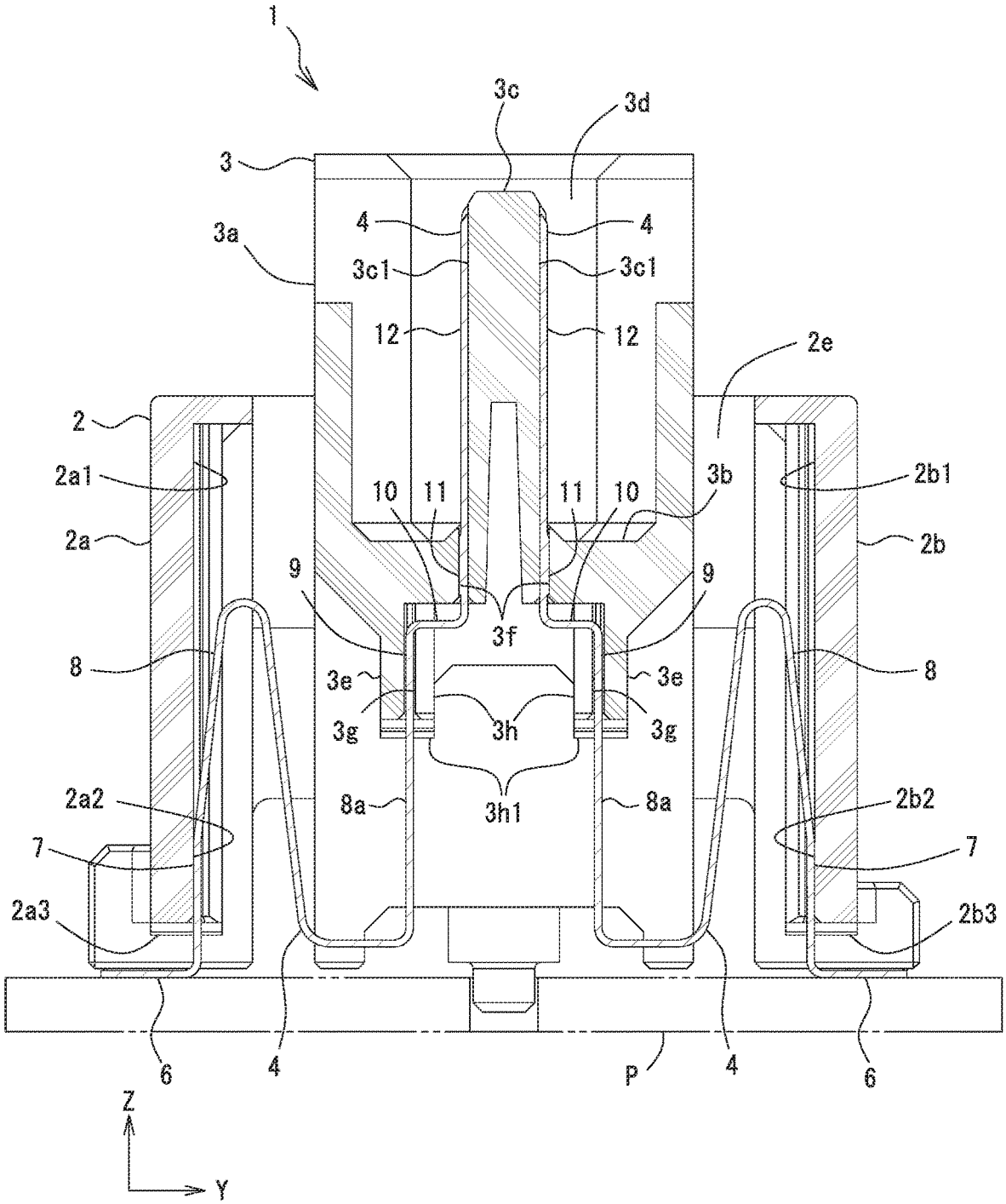
FIG. 3 is a cross-sectional view of the movable connector taken along the line III-III in FIG. 1.

The terms "first" and "second" as used herein are used to distinguish different components of the connector according to the present invention and are not intended to represent a specific order or superiority. For convenience of explanation herein, as illustrated in FIG. 1 and certain other figures, the term "X direction" refers to a side-to-side direction of the movable connector 1, the term "Y direction" refers to a front-back direction thereof, and the term "Z direction" refers to a height direction thereof. The term "lower" or "downward" as used herein refers to a direction toward the board P (refer to FIG. 3) in the height direction (Z direction) of the movable connector 1, and the term "upper" or "upward" as used herein refers to a direction from the board P toward the movable connector 1. These terms are not intended to limit the direction of engagement of the movable connector 1 and the manner of mounting the movable connector 1 to the board P.

Structure of Movable Connector 1

The movable connector 1 includes a fixed housing 2 as a "first housing" and a movable housing 3 as a "second housing". The movable housing 3 is elastically supported by a plurality of terminals 4 such that the movable housing 3 is movable in the X direction, serving as the longitudinal direction of the movable connector 1, the Y direction, serving as the depth direction thereof, and the Z direction, serving as the height direction thereof.

The fixed housing 2 is formed of a horizontally long, rectangular tubular resin molded product. The fixed housing 2 has a front wall 2*a*, a rear wall 2*b*, a right wall 2*c*, and a left wall 2*d*. Those walls define an inner space of the fixed housing 2. The inner space serves as a holding compartment 2*e* for the movable housing 3. The movable housing 3 is movable in the holding compartment 2*e*.

The front wall 2*a* has an inner surface 2*a*1 and the rear wall 2*b* has an inner surface 2*b*1. The inner surface 2*a*1 has a plurality of groove-shaped fixing portions 2*a*2 arranged in the X direction. The inner surface 2*b*1 has a plurality of groove-shaped fixing portions 2*b*2 arranged in the X direction. Those fixing portions 2*a*2 and 2*b*2 are groove-shaped. The terminals 4 each include a fixed-housing fixed portion 7, which will be described later. The fixed-housing fixed portions 7, each serving as a "first fixed portion" of the terminal 4, are press-fitted in and fixed to the fixing portions 2*a*2 and 2*b*2 such that each fixed-housing fixed portion 7 is pressed from both sides in its plate width direction (X direction). Insulating protrusions 2*a*3 and 2*b*3 are arranged to increase a creepage distance between the adjacent terminals 4 such that each insulating protrusion 2*a*3 is located between two adjacent fixing portions 2*a*2 and each insulating protrusion 2*b*3 is located between two adjacent fixing portions 2*b*2. Those insulating protrusions ensure the insulation between the adjacent terminals 4.

Fixing brackets 5 are attached to both end parts of each of the front wall 2*a* and the rear wall 2*b* in the X direction. The fixed housing 2 is firmly fixed to the board P by the fixing brackets 5 soldered to the board P. Each of the right wall 2*c* and the left wall 2*d* of the fixed housing 2 has recesses 2*f* to restrict excessive movement of the movable housing 3.

The movable housing 3 is formed of a horizontally long resin molded product having a U-shaped cross-section. The movable housing 3 includes a peripheral wall 3*a*, serving as front, rear, right, and left walls. The peripheral wall 3*a* includes displacement restricting protrusions 3*a*1 extending from a lower end of the peripheral wall 3*a*. The displacement restricting protrusions 3*a*1 are caught by the recesses 2*f* of the fixed housing 2, thus restricting excessive displacement of the movable housing 3. The movable housing 3 further includes a bottom wall 3*b* located in the lower end of the peripheral wall 3*a*. The movable housing 3 further includes a central wall 3*c* located in the middle of the bottom wall 3*b* in the front-back direction, or the Y direction. The central wall 3*c* protrudes upward from the bottom wall 3*b* in the height direction, or the Z direction. The peripheral wall 3*a* and the bottom wall 3*b* define an inner space, serving as an engagement compartment 3*d* for the mating connector, which serves as a connection target. The central wall 3*c* has a plurality of terminal attachment grooves 3*c*1 for retaining contact portions 12, which will be described later, of the terminals 4. The terminal attachment grooves 3*c*1 are arranged in the X direction. The bottom wall 3*b* includes one pair of terminal holding walls 3*e* protruding downward from a lower surface of the bottom wall 3*b* in the height direction, or the Z direction. The terminal holding walls 3*e* serve as front wall lower part and rear wall lower part included in the peripheral wall 3*a* of the movable housing 3. The terminal holding walls 3*e* face each other in the Y direction and extend in the X direction.

The movable housing 3 includes two terminal press-fit fixing portions for each terminal 4, that is, a first movable-housing fixing portion 3*f* located in the bottom wall 3*b* and a second movable-housing fixing portion 3*g* located in the terminal holding wall 3*e*. A plurality of first movable-housing fixing portions 3*f* and a plurality of second movable-housing fixing portions 3*g* are arranged in the X direction. Each first movable-housing fixing portion 3*f* is formed as a through-hole into which a first fixed piece portion 11, which will be described later, of the terminal 4 is press-fitted. Each second movable-housing fixing portion 3*g* is formed as a press-fit groove to which a second fixed piece portion 9, which will be described later, of the terminal 4 is press-fitted and fixed such that the second fixed piece portion 9 is pressed from both sides in its plate width direction (X direction). The second movable-housing fixing portion 3*g* is disposed in a partition wall 3*h*, which is located between two adjacent second fixed piece portions 9 and extends in a longitudinal direction of the second fixed piece portions 9. The partition wall 3*h* includes an insulating protrusion 3*h*1 for increasing a creepage distance between two adjacent terminals 4. The insulating protrusion 3*h*1 ensures the insulation between the adjacent terminals 4.

Figure 4:
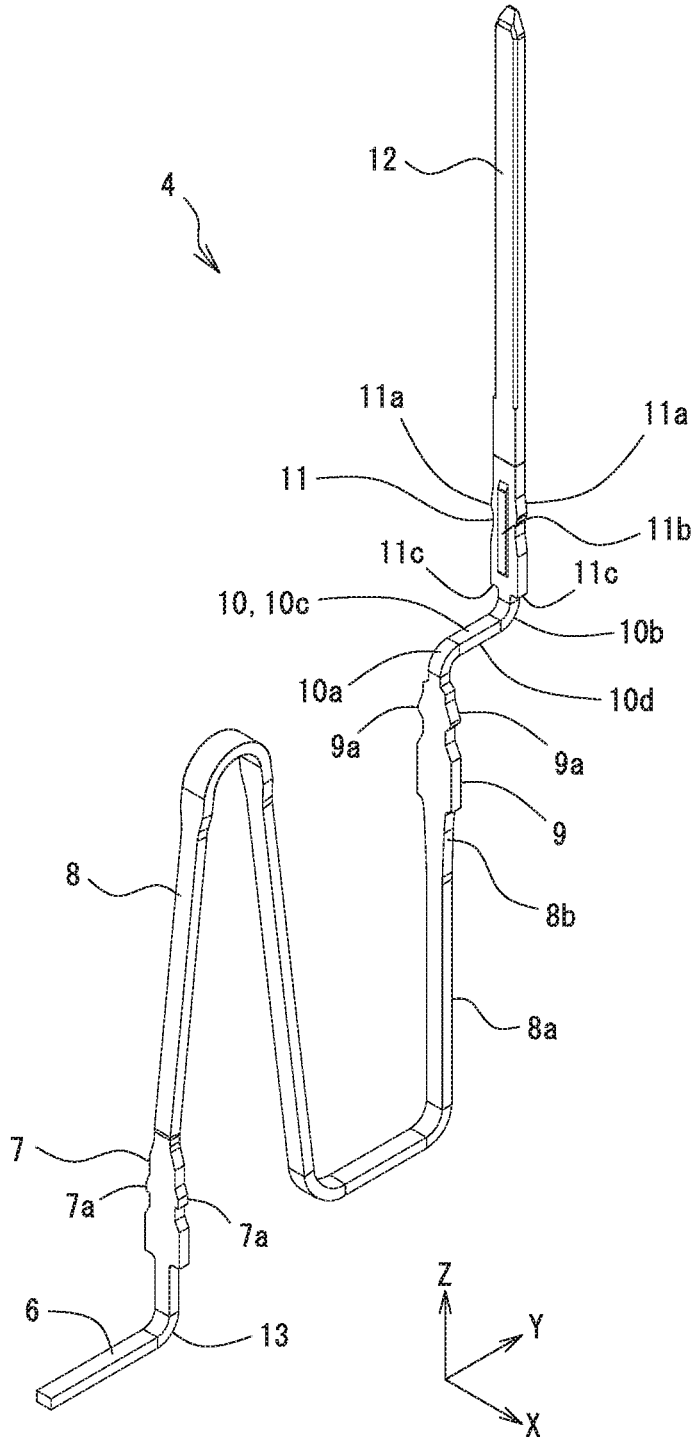
FIG. 4 is a perspective view illustrating the front, the plane, and the right side of a terminal included in the movable connector of FIG. 1.
Figure 5:
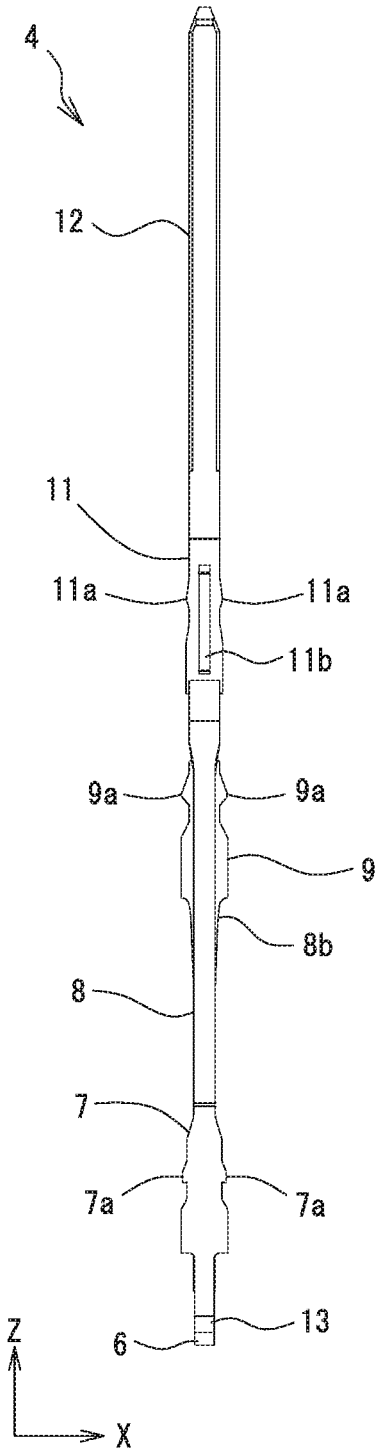
FIG. 5 is a front view of the terminal of FIG. 4.

As illustrated in, for example, FIG. 4, each terminal 4 includes a board fixed portion 6 soldered to the board P, the fixed-housing fixed portion 7 corresponding to the "first fixed portion", a movable portion 8, the second fixed piece portion 9, a connecting section 10, the first fixed piece portion 11, and the contact portion 12. The second fixed piece portion 9, the connecting section 10, and the first fixed piece portion 11 constitute a "second fixed portion".

The fixed-housing fixed portion 7 extends in the height direction, or the Z direction, from bent portion 13 upwardly bent from the board fixed portion 6. The fixed-housing fixed portion 7 includes press-fit protrusions 7*a* protruding from both edges thereof. The press-fit protrusions 7*a* are press-fitted into and fixed to the above-described fixing portion 2*a*2 or 2*b*2, so that one end part of the terminal 4 is firmly fixed to the fixed housing 2.

The movable portion 8 is formed as a spring and elastically supports the movable housing 3 such that the movable housing 3 is movable relative to the fixed housing 2. The movable portion 8 has a longitudinal-wave shape including a plurality of straight parts and two folded parts. The shapes of the respective parts and the length of the spring allow the movable portion 8 to have flexibility and durability that can distribute stress caused by elastic deformation resulting from engagement with the mating connector or from vibration or impact in engagement with the mating connector. The movable portion 8 includes vertically extending part 8*a* connected to the second fixed piece portion 9. The vertically extending part 8*a* includes tapered part 8*b* gradually increasing in plate width upwardly. The tapered part 8*b*, serving as one end of the movable portion 8, gradually increases in plate width toward the second fixed piece portion 9, which is fixed to the movable housing 3, and thus has enhanced durability or resistance to stress caused by elastic deformation of the movable portion 8 so that the tapered part 8*b* is not broken.

The second fixed piece portion 9 includes locking protrusions 9*a* protruding from both edges thereof and fixed to the second movable-housing fixing portion 3*g*. The second fixed piece portion 9 has no press-fit shoulder on which a press-fit jig is placed and to which a pressing force is applied with the press-fit jig. The locking protrusions 9*a* are press-fitted into the second movable-housing fixing portion 3*g* as the first fixed piece portion 11 is press-fitted into the first movable-housing fixing portion 3*f* by using a press-fit jig T. After being press-fit, the locking protrusions 9*a* lock in the second movable-housing fixing portion 3*g* such that the locking protrusions 9*a* are prevented from being pulled out of the fixing portion in a removal direction. The above-described shape of the locking protrusions 9*a* enables the locking protrusions 9*a* to be press-fitted into the second movable-housing fixing portion 3*g* by the pressing force, applied by using the press-fit jig T, acting through the connecting section 10 during press-fitting of the first fixed piece portion 11 and to be prevented from being pulled out of the fixing portion in the removal direction.

The connecting section 10 includes bent portion 10*a*, serving as a first end of the connecting section 10, connected to an upper end of the second fixed piece portion 9 and bent portion 10*b*, serving as a second end thereof, connected to the first fixed piece portion 11. The connecting section 10 further includes straight, horizontally extending part 10*c* extending in an intersecting direction (Y direction) intersecting a press-fit direction (Z direction) in which the first fixed piece portion 11 and the second fixed piece portion 9 are press-fitted into the movable housing 3. The horizontally extending part 10*c* has a lower surface exposed by protruding from the surface of the movable housing 3. As will be described later, the lower surface of the horizontally extending part 10*c* serves as press receiving part 10*d* against which the press-fit jig T can be pressed.

The plate width of the connecting section 10 in the X direction is preferably 1 to 1.5 times larger than the thickness of a metal sheet, serving as a material for the terminal 4. If the plate width of the connecting section 10 in the X direction is not as large as the thickness of the metal sheet, it is difficult to stamp the connecting section 10 from the metal sheet. If the plate width of the connecting section 10 in the X direction is more than 1.5 times larger than the thickness of the metal sheet, this leads to an increase in plate width of the first fixed piece portion 11, which will be described later, so that it is difficult to provide a proper interval for small-pitch arrangement of the terminals 4. A function required for the connecting section 10 is to connect the first fixed piece portion 11 to the second fixed piece portion 9. Unlike the movable portion 8, the connecting section 10 is not required to be resistant to elastic deformation. Therefore, the connecting section 10 can be formed to have the smallest plate width manufacturable, for example. In the present embodiment, the connecting section 10 has a plate width of 0.17 mm and a thickness of 0.12 mm, and the plate width is approximately 1.4 times larger than the thickness. This dimensional relationship enables stable mass production of the terminals 4.

The first fixed piece portion 11 includes locking protrusions 11*a* protruding from both edges thereof and press-fitted in and fixed to the first movable-housing fixing portion 3*f*. The first fixed piece portion 11 includes a bead-shaped press-fit protrusion 11*b* protruding from the surface of the first fixed piece portion 11 and press-fitted in the first movable-housing fixing portion 3*f*, which is a through-hole. The first fixed piece portion 11 further includes press-fit shoulders 11*c*, to which a pressing force is applied with the press-fit jig T, protruding on both sides from part connected to the bent portion 10*b* of the connecting section 10.

The contact portion 12 is disposed in the terminal attachment groove 3*c*1 of the movable housing 3 and is configured to be in electrical contact with a socket terminal of the mating connector, serving as a connection target.

Method for Assembly of Movable Connector 1

To assemble the movable connector 1, the fixed housing 2 formed of a resin molded product, the movable housing 3 formed of a resin molded product, the terminals 4 each formed of a metal processed product, and the fixing brackets 5 each formed of a metal processed product are first prepared. Then, the first fixed piece portions 11 are press-fitted into and fixed to the respective first movable-housing fixing portions 3*f*, and the second fixed piece portions 9 are press-fitted into and fixed to the respective second movable-housing fixing portions 3*g*. After that, the movable housing 3 is disposed in the holding compartment 2*e* of the fixed housing 2, and the fixed-housing fixed portions 7 of the terminals 4 are press-fitted into and fixed to the fixing portions 2*a*2 and 2*b*2. The fixing brackets 5 may be attached to the fixed housing 2 at any time point.

The press-fit jig T is used to press-fit each first fixed piece portion 11 into the first movable-housing fixing portion 3*f*. First pressing part T1 of the press-fit jig T is placed on and pressed against the press-fit shoulder 11*c* of the first fixed piece portion 11 to apply a pressing force to the press-fit shoulder 11*c*, thus press-fitting the first fixed piece portion 11 into the first movable-housing fixing portion 3*f*. Since the connecting section 10 extends in the intersecting direction (Y direction) intersecting the first fixed piece portion 11, the connecting section 10 does not interfere with placement of the press-fit jig T on the press-fit shoulder 11*c* of the first fixed piece portion 11, thus allowing smooth press-fitting.

The lower surface of the horizontally extending part 10*c* of the connecting section 10 is exposed by protruding from the surface of the movable housing 3 and functions as the press receiving part 10*d* against which second pressing part T2 of the press-fit jig T can be pressed. As will be described later, the second fixed piece portion 9 has no press-fit shoulder. As the first fixed piece portion 11 is press-fitted into the first movable-housing fixing portion 3*f*, the second fixed piece portion 9 is also press-fitted into the second movable-housing fixing portion 3*g*. If the second fixed piece portion 9 fails to be smoothly press-fitted into the second movable-housing fixing portion 3*g* for any reason, the bent portions 10*a* and 10*b* of the connecting section 10 may undergo plastic deformation such that the angle of curvature of each bent portion increases. However, the second pressing part T2 of the press-fit jig T can be pressed against the press receiving part 10*d* of the connecting section 10. This eliminates the likelihood that the second fixed piece portion 9 may fail to be smoothly press-fitted into the second movable-housing fixing portion 3*g* and the connecting section 10 may thus undergo plastic deformation, and further ensures that the second fixed piece portion 9 is appropriately press-fitted into and fixed to the movable housing 3.

As the first fixed piece portion 11 is press-fitted into the first movable-housing fixing portion 3*f*, the second fixed piece portion 9 is also press-fitted into the second movable-housing fixing portion 3*g* in the above-described manner. The second fixed piece portion 9 is connected to the first fixed piece portion 11 by the connecting section 10. A pressing force applied to the first fixed piece portion 11 by using the press-fit jig T acts on the second fixed piece portion 9 through the connecting section 10. Consequently, the second fixed piece portion 9 can be press-fitted into the second movable-housing fixing portion 3*g* by such an indirect pressing force acting through the connecting section 10. Additionally, as described above, the second pressing part T2 of the press-fit jig T is pressed against the press receiving part 10*d* of the connecting section 10 to press the connecting section 10 in the press-fit direction (Z direction), so that the second fixed piece portion 9 is pulled by the connecting section 10 and is press-fitted into the second movable-housing fixing portion 3*g*. The second fixed piece portion 9 with no press-fit shoulder can be press-fitted in the above-described manner.

Advantages of Movable Connector 1

Other advantages, except the advantages described above, of the movable connector 1 will be described.

In the movable connector 1, the first fixed piece portion 11 with the press-fit shoulders 11*c*, the connecting section 10, and the second fixed piece portion 9 are interposed between the contact portion 12 and the movable portion 8. This arrangement eliminates the need to connect one edge, along which the press-fit shoulders 11*c* are located, of the first fixed piece portion 11 to one end of the movable portion 8. It is only required that the press-fit shoulders 11*c* and the connecting section 10 are arranged along this edge. This arrangement contributes to a reduction in pitch between the adjacent terminals 4.

Figure 6:
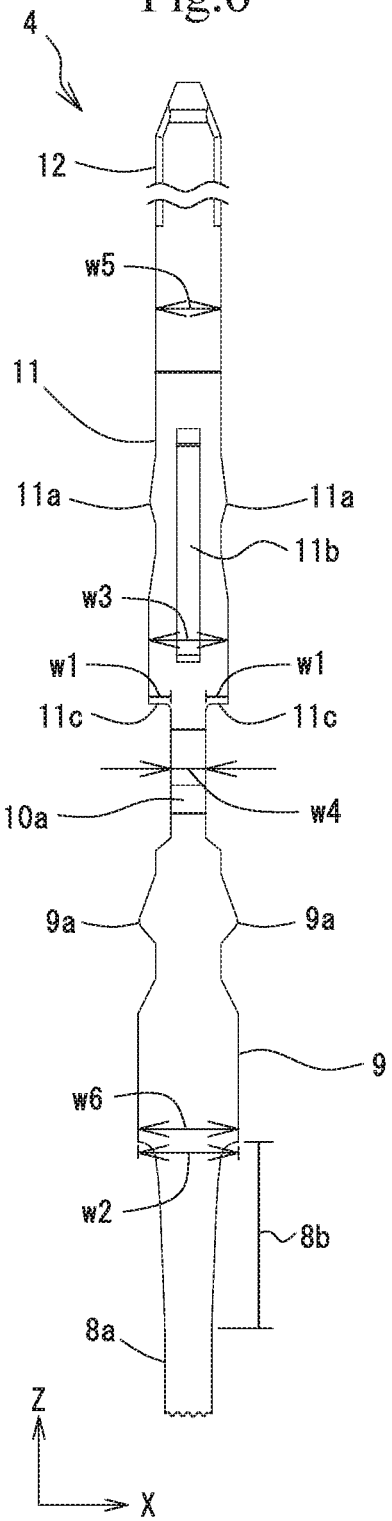
FIG. 6 is an enlarged front view of parts of the terminal of FIG. 4.
Figure 7:
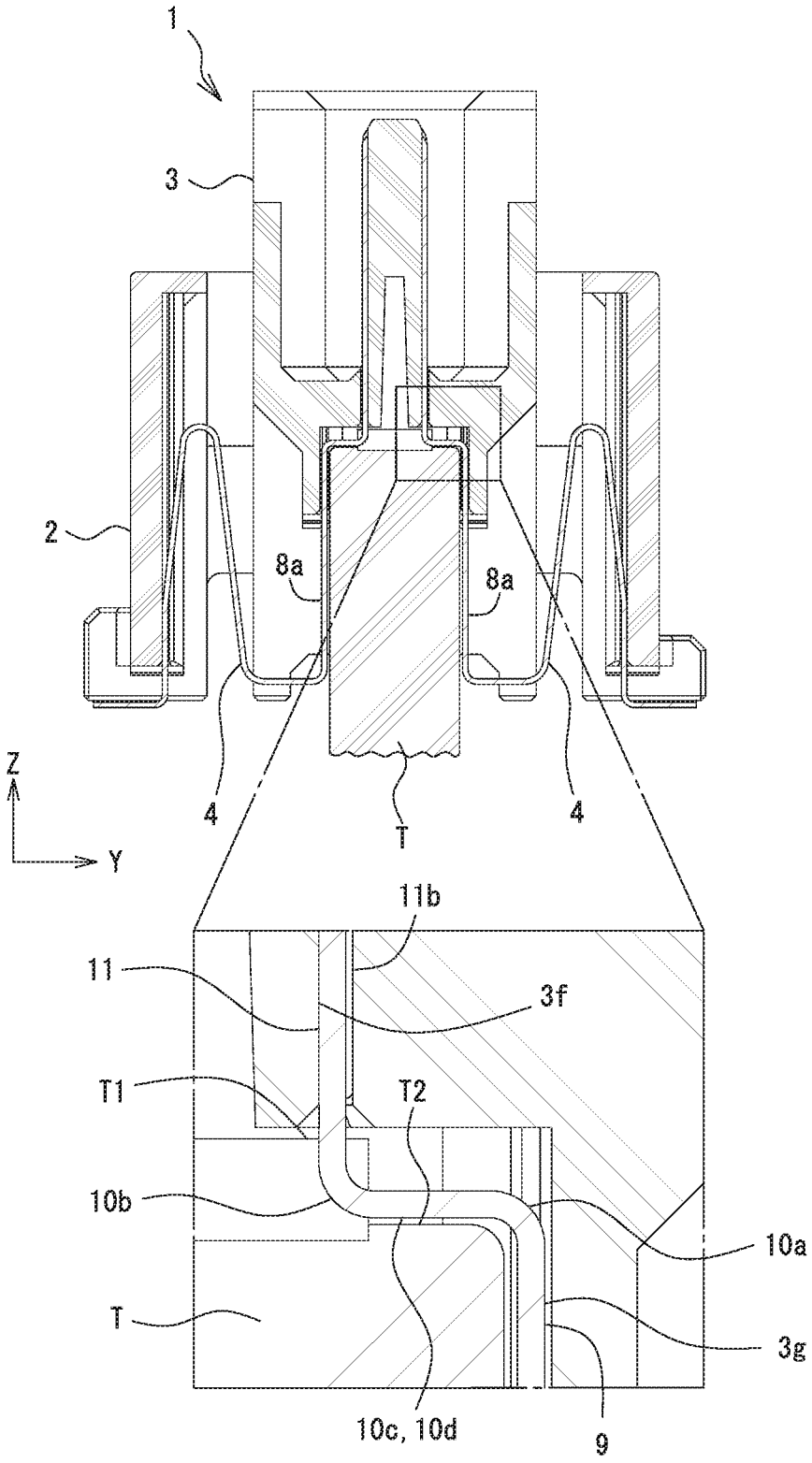
FIG. 7 is a cross-sectional view, corresponding to FIG. 3, of the movable connector of FIG. 1 and illustrates terminals press-fitted in the connector.

Specifically, if the first fixed piece portion 11 is directly connected to one end of the movable portion 8, a dimension obtained by combining the widths, indicated at w1, of the right and left press-fit shoulders 11*c* and the plate width, indicated at w2, of a proximal end of the tapered part 8*b* of the movable portion 8 corresponds to the smallest plate width, indicated at w3, of the first fixed piece portion 11. In contrast, in the movable connector 1 according to the present embodiment, the connecting section 10 is enabled to have a plate width w4 smaller than the plate width w2 of the tapered part 8*b* of the movable portion 8, as illustrated in FIG. 6, for the following reason. Unlike the movable portion 8, the connecting section 10 does not receive stress caused by supporting the movable housing 3 movably. Consequently, the overall plate width w3 of the first fixed piece portion 11 can be reduced based on the widths w1 of the press-fit shoulders 11*c* and the plate width w4 of the connecting section 10. Thus, the plate width, indicated at w5, of the contact portion 12 connected to the first fixed piece portion 11 can also be reduced to a dimension substantially equal to the plate width w3 of the first fixed piece portion 11. This enables the adjacent terminals 4 to be arranged at a small pitch. In the present embodiment, the contact portions 12 of the terminals 4 can be arranged at a pitch of, for example, 0.8 mm, even though the movable connector 1 includes the movable portions 8.

The second fixed piece portion 9 includes part connected to the movable portion 8, and this part has a plate width w6. Since the second fixed piece portion 9 does not have to have press-fit shoulders, the overall plate width w6 of the part connected to the movable portion 8 can also be reduced. Thus, the second fixed piece portion 9 can also contribute to small-pitch arrangement of the terminals.

Modifications of Movable Connector 1

Various modifications of the movable connector 1 according to the present embodiment can be made. One of the modifications will now be described.

In the above-described embodiment, the contact portion 12 of each terminal 4 is a plug terminal to be in electrical contact with the socket terminal of the mating connector. The contact portion 12 may be configured as a contact portion of a socket terminal. Furthermore, the movable housing 3 may be configured as a movable housing of a socket connector.

What is claimed is:

1. A movable connector comprising:

a first housing;

a second housing movable relative to the first housing; and a plurality of terminals each including a first fixed portion fixed to the first housing, a second fixed portion fixed to the second housing, a movable portion connecting the first fixed portion to the second fixed portion and movably supporting the second housing relative to the first housing, and a contact portion extending from the second fixed portion, the contact portion being configured to be in electrical contact with a connection target, wherein the second fixed portion includes:

a first fixed piece portion connected to the contact portion and having a press-fit shoulder which a pressing force is applied by using a press-fit jig during press-fitting into the second housing, a second fixed piece portion connected to the movable portion and being fixed to the second housing and having no press-fit shoulder, and a connecting section connecting the first fixed piece portion to the second fixed piece portion, and the second fixed piece portion fixed to the second housing such that the second fixed piece portion is pressed by the second housing from both sides of the second fixed piece portion in a plate width direction of the second fixed piece portion.

2. The movable connector according to claim 1, wherein the connecting section has a plate width smaller than that of the first fixed piece portion and that of the second fixed piece portion.

3. The movable connector according to claim 1, wherein the connecting section extends in an intersecting direction intersecting a press-fit direction in which the first fixed piece portion is press-fitted into the second housing.

4. The movable connector according to claim 1, wherein the second fixed piece portion includes a locking protrusion, on which the pressing force acts through the connecting section during press-fitting of the first fixed piece portion, the locking protrusion being press-fitted in the second housing and prevented from being pulled out of the second housing.

5. The movable connector according to claim 1, wherein the connecting section includes press receiving part, against which the press-fit jig is pressed during press-fitting of the first fixed piece portion into the second housing, the press receiving part being exposed by protruding from a surface of the second housing.

6. The movable connector according to claim 1, wherein the second fixed piece portion has a locking portion for locking the second fixed portion to the second housing.

7. The movable connector according to claim 6, wherein the locking portion is a locking protrusion.

* * * * *